US007101100B2

(12) United States Patent
Hoshino et al.

(10) Patent No.: US 7,101,100 B2
(45) Date of Patent: Sep. 5, 2006

(54) PRINTER APPARATUS

(75) Inventors: Minoru Hoshino, Chiba (JP); Norimitsu Sanbongi, Chiba (JP); Tatsuya Obuchi, Chiba (JP); Yoshinori Sato, Chiba (JP)

(73) Assignee: Seiko Instruments Inc., (JP)

( * ) Notice: Subject to any disclaimer, the term of this patent is extended or adjusted under 35 U.S.C. 154(b) by 125 days.

(21) Appl. No.: 10/965,111

(22) Filed: Oct. 14, 2004

(65) Prior Publication Data

US 2006/0083570 A1 Apr. 20, 2006

(51) Int. Cl.
*B41J 2/315* (2006.01)
*B41J 2/32* (2006.01)

(52) U.S. Cl. ..... 400/120.01; 347/177; 347/217; 347/171; 400/120.14; 400/279

(58) Field of Classification Search ..... 101/128.21; 347/171, 221, 177, 217; 400/120.01, 120.14, 400/707.1
See application file for complete search history.

(56) References Cited

U.S. PATENT DOCUMENTS 5,122,882 A * 6/1992 Ishida et al. ..... 358/296
5,481,291 A * 1/1996 Ishida et al. ..... 347/217
5,534,908 A * 7/1996 Takeda et al. ..... 347/215
6,031,553 A * 2/2000 Nagamoto et al. ..... 347/171
6,084,624 A * 7/2000 Yamakawa ..... 347/175
6,168,325 B1 * 1/2001 Nagata ..... 400/120.01
6,172,698 B1 * 1/2001 Iwata et al. ..... 347/171
6,190,066 B1 * 2/2001 Ishigouoka et al. .... 400/120.01
6,206,589 B1 * 3/2001 Bjork et al. ..... 400/120.13
6,271,872 B1 * 8/2001 Nagata ..... 347/171
6,305,856 B1 * 10/2001 Miyazaki ..... 400/279
6,533,477 B1 * 3/2003 Fukuda ..... 400/120.01
6,624,876 B1 * 9/2003 Fukuda et al. ..... 355/29
6,641,314 B1 * 11/2003 Mogi ..... 400/120.01
6,788,323 B1 * 9/2004 Enomoto et al. ..... 347/177
6,850,262 B1 * 2/2005 Yoshida et al. ..... 347/171
6,863,457 B1 * 3/2005 Hayashi ..... 400/279
6,877,917 B1 * 4/2005 Hoshino et al. ..... 400/120.01
6,923,534 B1 * 8/2005 Sai ..... 347/104
6,947,066 B1 * 9/2005 Sato et al. ..... 347/217
2001/0004284 A1 * 6/2001 Fukuda et al. ..... 355/29
2003/0063181 A1 * 4/2003 Taki et al. ..... 347/212
2003/0151656 A1 * 8/2003 Kokubo et al. ..... 347/175

(Continued)

*Primary Examiner*—Ren Yan
*Assistant Examiner*—Matthew Marini
(74) *Attorney, Agent, or Firm*—Adams & Wilks

(57) ABSTRACT

Provided is a printer apparatus, including: a thermal print head that performs printing by contacting a heat-sensitive color-developing layer of a heat-sensitive adhesive sheet that includes a printable surface made from the heat-sensitive color-developing layer on one surface of a sheet-like base material, and a heat-sensitive adhesive layer on another surface of the sheet-like base material; a thermal-activation thermal head that activates the heat-sensitive adhesive layer by heating; a cutter device that cuts the heat-sensitive adhesive sheet; a transporting unit that transports the heat-sensitive adhesive sheet; and a controlling unit that controls the thermal print head, the thermal-activation thermal head, and the cutter device. The controlling unit controls the transporting unit to transport the heat-sensitive adhesive sheet so as to pass through the thermal print head, the thermal head used for activation, and the cutter device, in order; and to transport a leading edge of a remainder portion of the heat-sensitive adhesive sheet, after the cutter device cuts the heat-sensitive adhesive sheet, to return to a printing position of the thermal print head or to a heating position of the thermal-activation thermal head.

8 Claims, 9 Drawing Sheets

U.S. PATENT DOCUMENTS

2003/0227534 A1* 12/2003 Enomoto et al. ..... 347/177
2003/0227535 A1* 12/2003 Enomoto et al. ..... 347/188
2004/0004656 A1* 1/2004 Sambongi et al. ..... 347/171
2004/0085433 A1* 5/2004 Otaka et al. ..... 347/193
2004/0233269 A1* 11/2004 Tsubota ..... 347/223
2005/0068403 A1* 3/2005 Okuchi et al. ..... 347/194

* cited by examiner

PRINTER APPARATUS

BACKGROUND OF THE INVENTION

1. Field of the Invention

The present invention relates to a printer apparatus for a heat-sensitive adhesive sheet in which a heat-sensitive adhesive layer that is normally non-adhesive and exhibits adhesion only when heated is formed on one side of a sheet-like base material.

2. Description of the Related Art

Thermal activation sheets (print medium in which a coat layer containing a thermal activation component is formed on the surface, for example, heat-sensitive adhesive sheets) have recently become available as sheets to be applied to merchandises, and are used in wide fields. Examples of uses of thermal activation sheets include POS sheets for food products, delivery address sheets, sheets bearing medical information, baggage tags, and labels of bottles and cans.

Those heat-sensitive adhesive sheets are composed of a sheet-like base material (base paper, for example) one side of which has a heat-sensitive adhesive layer and the other side of which is a printable surface. The heat-sensitive adhesive layer is normally non-adhesive and exhibits adhesion when heated.

Heat-sensitive adhesives contain a thermoplastic resin, a solid plasticizer, or the like as a main constituent, and accordingly do not exhibit adhesive characteristics at normal temperatures. The heat-sensitive adhesives have property in which they become activated by heating with a thermal activation device, and exhibit adhesion. Activation temperatures are normally from 50 to 150° C. The solid plasticizer within the thermoplastic resin melts in this temperature range, and imparts adhesion to the thermoplastic resin. The melted solid plasticizer then gradually crystallizes via a supercooled state. Accordingly, the adhesive characteristics persist for a predetermined period of time. The heat-sensitive adhesive is applied to a surface of an object such as a glass bottle during the period where the adhesion is kept.

A "Linerless Label Printer" disclosed in JP 2000-264322 A has been proposed as a printer apparatus that uses this kind of heat-sensitive adhesive sheet.

According to the disclosed printer apparatus, after a thermoplastic adhesive layer is activated by a thermal activation device, desired characters, images, and the like can be printed on a printable surface of a heat-sensitive adhesive sheet by using a thermal printer apparatus. The heat-sensitive adhesive sheet can then cut into a predetermined length.

A display sheet is applied to a glass bottle used for alcoholic beverages or pharmaceuticals, to a plastic container, or the like, or a price label or an advertisement sheet is applied thereto, after adhesion develops in the thermoplastic adhesive sheet. Thus, there is an advantage in that costs can be reduced because release paper (liner) like that employed with conventional general adhesive label sheets is unnecessary. Further, the linerless label printer also has merit from the viewpoint of resource-saving and environmental protection because the release paper, which becomes waste after use, is not necessary.

However, with the conventional printer apparatus described above, the desired characters, images, and the like are printed onto the printable surface of the heat-sensitive adhesive sheet by the thermal printer apparatus after the heat-sensitive adhesive layer is activated by the thermal activation device.

The heat-sensitive adhesive sheet in which adhesion has developed is transported to the thermal printer apparatus. A problem thus exists in which paper jamming tends to occur because the heat-sensitive adhesive sheet adheres to a platen roller used for printing, and then winds around the platen roller.

Further, configuring surfaces of the platen roller used for printing by using a material having a relatively low surface energy substance as a main constituent, such as a silicone resin or a fluorine resin, to which the heat-sensitive adhesive sheet does not easily adhere, has been considered in order to make paper jam like that describe above less likely to occur. There is a problem, however, in that manufacturing costs are high.

Furthermore, the thermal activation device performs thermal activation with the printer apparatus described above, and the thermal printer apparatus prints the desired characters, images, and the like. The sheet is then cut into a desired length by using a cutter device. There is a danger that the heat-sensitive adhesive that has developed adhesion will adhere to a blade of the cutter device, lowering the cutting quality. With the printing apparatus described above, inactive areas of the heat-sensitive adhesive layer (that is, regions where heating processing is not performed by the thermal activation device, and where adhesion does not develop) are provided in a leading edge portion and a trailing edge portion that correspond to cutting positions of the heat-sensitive adhesive sheet. Adhering of the heat-sensitive adhesive on the blade of the cutter device in the cutting positions can thus be avoided.

However, the inactive areas where, as described above, the heat-sensitive adhesive layer is not active and where adhesion does not develop, remain in the leading edge portion and the trailing edge portion of the heat-sensitive adhesive sheet (label) that has been cut by the cutter device. There is a problem in that when applying the heat-sensitive adhesive sheet to an object the areas without adhesion easily peel.

Further, it is necessary to stop transporting the heat-sensitive adhesive sheet when performing cutting by the cutter device, and a thermal head of the thermal activation device has residual heat even after electric power is cut off. Accordingly, there is a danger that the heat-sensitive adhesive layer of the heat-sensitive adhesive sheet positioned in the thermal activation device will be activated and adhere to the thermal head, and there is a danger that heat will penetrate to the printable surface, resulting in unnecessary color development.

SUMMARY OF THE INVENTION

The present invention has been made in order to solve the problems described above. An object of the present invention is to provide a printer apparatus that is capable of reducing jamming of the heat-sensitive adhesive sheet without increasing costs, that is capable of performing activation processing where peeling from an object does not easily occur, and that is capable of preventing unnecessary activation and color development due to residual heat in a thermal-activation thermal head.

In order to achieve the object described above, the present invention provides a printer apparatus, including: a thermal print head that performs printing by contacting a heat-sensitive color-developing layer of a heat-sensitive adhesive sheet that includes a printable surface made from the heat-sensitive color-developing layer on one surface of a sheet-like base material, and a heat-sensitive adhesive layer on another surface of the sheet-like base material; a thermal-activation thermal head that activates the heat-sensitive adhesive layer by heating; a cutter device that cuts the heat-sensitive adhesive sheet; transporting means for transporting the heat-sensitive adhesive sheet; and controlling means for controlling the thermal print head, the thermal-activation thermal head, and the cutter device. The controlling means controls the transporting means to transport the heat-sensitive adhesive sheet so as to pass through the thermal print head, the thermal head used for activation, and the cutter device, in order. The controlling means also controls the transporting means to transport a leading edge of a remainder portion of the heat-sensitive adhesive sheet, after the cutter device cuts the heat-sensitive adhesive sheet, to return to a printing position of the thermal print head or to a heating position of the thermal-activation thermal head.

Printing processing is thus performed on the printable surface of the heat-sensitive adhesive sheet by the thermal print head, and activation processing of the heat-sensitive adhesive layer is then performed by the thermal-activation thermal head. The heat-sensitive adhesive sheet is then cut to a predetermined length by the cutter device. Paper jam in which the heat-sensitive adhesive sheet adheres to a platen roller used for printing, which is caused by performing activation processing before printing processing with a conventional printer, can thus be avoided.

Further, a leading edge side of the heat-sensitive adhesive sheet is cut by the cutter device at a predetermined cutting position, and the leading edge of the remainder portion in front of the cutting position of the heat-sensitive adhesive sheet is returned to the thermal print head position or to the thermal-activation thermal head position. Accordingly, even if an area where thermal activation processing is not performed remains in the leading edge portion of the reminder portion in front of the cutting position of the heat-sensitive sheet, the thermal-activation thermal head reliably performs thermal activation processing in the next process. Inactive portions (regions where adhesion does not develop) can therefore be prevented, at minimum, from occurring in the heat-sensitive adhesive layer of the leading edge portion of the heat-sensitive adhesive sheet after cutting. Peeling when applying the heat-sensitive adhesive sheet to an object does not tend to occur.

Further, the leading edge of the remainder portion in front of the cutting position of the heat-sensitive adhesive sheet is returned to the thermal print head position or to the thermal-activation thermal head position. Unnecessary activation and color development can therefore be prevented.

The printing apparatus further includes a temperature sensor that measures a temperature of the thermal-activation thermal head. In the printing apparatus, the controlling means may drive the transporting means to continue to transport the heat-sensitive adhesive sheet when the temperature of the thermal-activation thermal head measured by the temperature sensor is equal to or greater than a predetermined value; drive the transporting means so that the cutting position of the heat-sensitive adhesive sheet stops at a cutting portion of the cutter device when the measured temperature of the thermal-activation thermal head is equal to or less than the predetermined value; and drive the cutter device to perform cutting. The thermal-activation thermal head is thus equal to or less than the predetermined temperature when the cutter device cuts the heat-sensitive adhesive sheet. Conditions where residual heat activates the heat-sensitive adhesive layer or develop color on the heat-sensitive color-developing layer of the printable surface can therefore be reliably avoided.

Furthermore, in the printing apparatus, a distance from the thermal-activation thermal head to the cutter device, and a transport speed of the transporting means may be set so that the thermal-activation thermal head is at a temperature equal to or less than the predetermined temperature when the cutting position of the heat-sensitive adhesive sheet reaches the cutter device. Conditions where residual heat at a temperature equal to or greater than the predetermined temperature of the thermal-activation thermal head causes the heat-sensitive adhesive layer of the heat-sensitive adhesive sheet located at the thermal-activation thermal head to activate, or causes the heat-sensitive color-developing layer of the printable surface to develop color when cutting processing of the heat-sensitive adhesive sheet is performed by the cutter device can thus be reliably avoided.

The printing apparatus further includes thermal head separating means for withdrawing a surface of the thermal-activation thermal head from the heat-sensitive adhesive sheet. In the printing apparatus, the controlling means may stop the transporting means, and may operate the thermal head separating means, when the cutting position of the thermal sensitive adhesive sheet reaches the cutter device. The heat-sensitive adhesive sheet located at the thermal-activation thermal head is thus separated from the thermal-activation thermal head when the cutter device performs cutting processing of the heat-sensitive adhesive sheet. Accordingly, conditions where the heat-sensitive adhesive layer activates or the heat-sensitive color-developing layer of the printable surface develops color due to the thermal-activation thermal head can be more reliably avoided.

Further, in the printing apparatus, the thermal head separating means may include: an actuated striker member that is provided on a lower surface side of the thermal-activation thermal head and capable of upward and downward movement operation together with the thermal-activation thermal head; and a cam mechanism that contacts a portion of the actuated striker member and converts rotational motion into upward and downward motion. The thermal head separating means can thus be realized by using a simple, low cost structure.

Furthermore, in the printing apparatus, the thermal head separating means may include: an actuated striker member that is provided on a lower surface side of the thermal-activation thermal head and capable of upward and downward movement operation together with the thermal-activation thermal head; and an actuator that contacts a portion of the actuated striker member and causes the actuated striker member to move upward and downward. The thermal head separating means can thus be realized by using a simple structure.

It should be noted that in the printing apparatus, the actuator may be one of a solenoid, a pneumatic cylinder apparatus, and a hydraulic cylinder apparatus. Upward and downward motion of the thermal-activation thermal head can thus be easily achieved.

Further, in the printing apparatus, the cutting position of the heat-sensitive adhesive sheet may be an inactivation position that is separated by a predetermined distance, in a direction that is opposite to a transporting direction, from a position at which activation by the thermal-activation thermal head is completed. The heat-sensitive adhesive layer in the cutting position of the heat-sensitive adhesive sheet thus is not activated, and a condition where the heat-sensitive adhesive adheres to the blade of the cutter device, lowering cutting quality, can thus be avoided.

DETAILED DESCRIPTION OF THE PREFERRED EMBODIMENTS

Preferred embodiments of the present invention are explained below based on the drawings.

Figure 1:
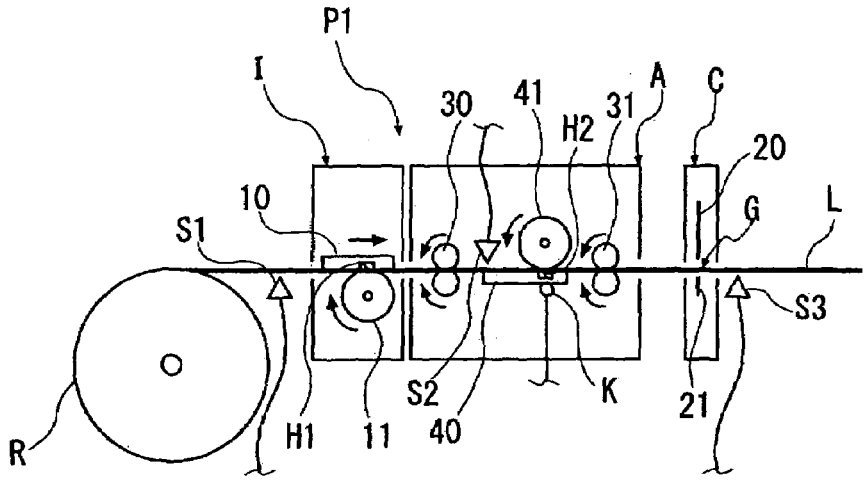
FIG. 1 is a schematic diagram that shows a configuration of a thermal printer apparatus according to the present invention.
Figure 2:
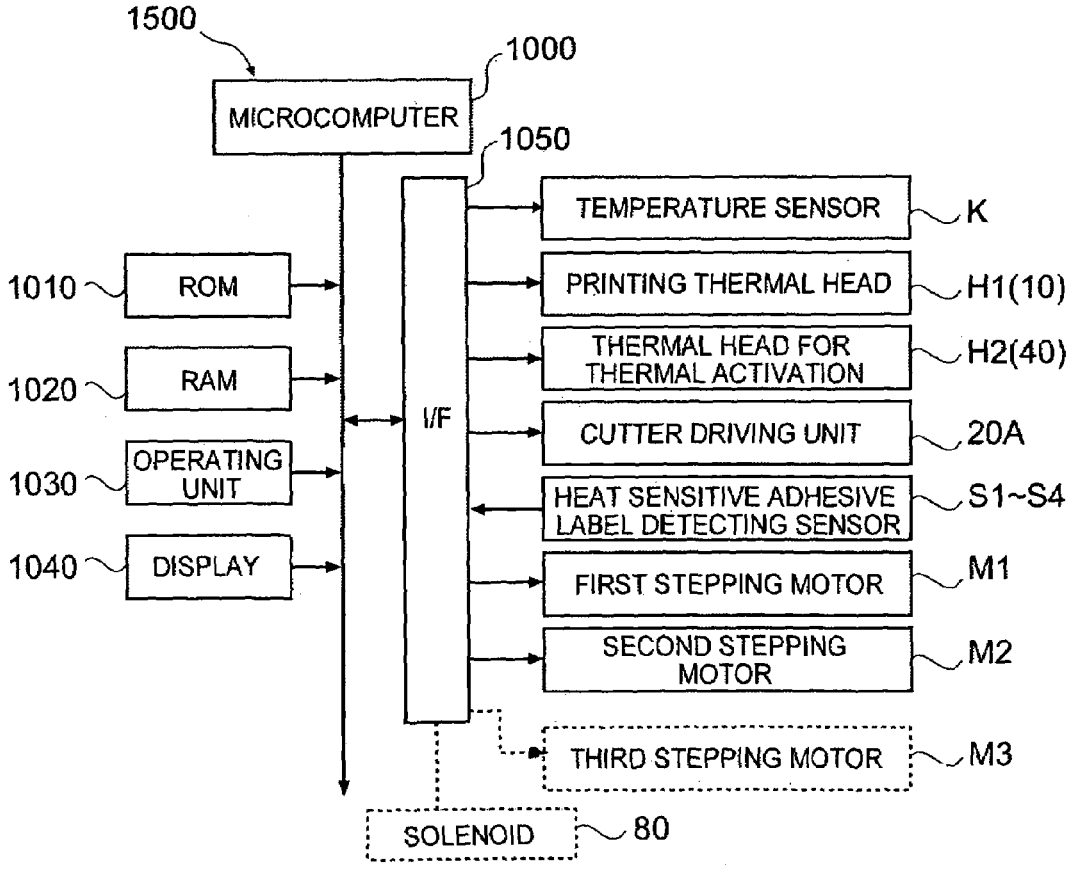
FIG. 2 is a control block diagram of a thermal printer apparatus according to the present invention.

FIG. 1 is a schematic diagram that shows a configuration of a thermal printer apparatus P1 according to a first embodiment of the present invention. FIG. 2 is a control block diagram for the thermal printer P1.

Referring to FIG. 1, the thermal printer apparatus P1 includes a printer unit I, a thermal activation unit A as a thermal activation device, and a cutter unit C that are disposed in order in a transporting direction (a direction toward the right in FIG. 1) of a heat-sensitive adhesive label L. It should be noted that a heat-sensitive adhesive sheet roll R, around which a continuous sheet of the heat-sensitive adhesive labels L are wound, is disposed in the vicinity of the printer unit I.

The printer unit I includes a thermal print head 10, a platen roller 11 that is pressed onto the thermal print head 10, and a drive system, which is not shown, that rotates the platen roller 11 (a first stepping motor M1 and a gear train, for example). By rotating the platen roller 11 in a clockwise direction in FIG. 1, the heat-sensitive adhesive label L is drawn out form the roll R, and the drawn out heat-sensitive adhesive label L is transported in a direction toward the right hand side after heat-sensitive printing is performed. Further, the thermal printer head 10 includes pressing means (such as a coil spring or a leaf spring), which is not shown. A surface of the thermal print head 10 is pressed onto the platen roller 11 by a snapping force of the pressing means.

A heater element H1 of the thermal print head 10 is configured by a plurality of relatively small resistors that are arranged in parallel in a width direction of the thermal print head 10 so as to enable dot printing. On the other hand, a heater element H2 that is used as an electric heating source for a thermal-activation thermal head 40, which is described later, does not need to be divided into dot units like the heater element H1 of the thermal print head 10. A continuous resistor such as a thermal bar used in a laser printer or the like may be used. Further, it is also possible to employ a thermal roll in which cylindrical shape resistors are made to rotate, which is used in a laser printer or the like, as a substitute for the thermal head or the thermal bar.

It should be noted that component commonality and cost reductions can also be achieved by using resistors having the same structure for the thermal print head 10 and the thermal-activation thermal head 40.

There are no particular limitations placed here on the heat-sensitive adhesive labels L used in this embodiment. However, the heat-sensitive adhesive labels L have a structure in which, for example, a heat-insulating layer and a heat-sensitive color-developing layer (layer where printing is possible) are provided in a front surface side of a label-like base material, and a heat-sensitive adhesive layer, in which a heat-sensitive adhesive is applied and dried, is provided on a rear side. It should be noted that the heat-sensitive adhesive layer is made from a heat-sensitive adhesive having a thermoplastic resin, a solid plasticizer resin, or the like as a main constituent. Further, the heat-sensitive adhesive labels L may need not have the heat-insulating layer. Labels having a protective layer or a colored printed layer (preprinted layer) provided to a surface of the heat-sensitive color-developing layer may also be used.

Desired printing to the heat-sensitive color-developing layer (printable surface) of the heat-sensitive adhesive label L can then be performed by operating the thermal print head 10 and the printing platen roller 11 (the first stepping motor M1) based on a printing signal from the control device 1500 that is described later.

The thermal activation unit A includes an insertion roller 30 and a discharge roller 31 that are rotated by using a drive source (second stepping motor M2) that is not shown, for example. The insertion roller 30 and the discharge roller 31 perform insertion and discharge of the heat-sensitive label L that is transported from the printing unit I. The thermal activation unit A also includes a thermal-activation thermal head 40, and a thermal activation platen roller 41 that is pressed onto the thermal-activation thermal head 40, which are disposed between the insertion roller 30 and the discharge roller 31. The thermal activation platen roller 41 includes a drive system (the second stepping motor M2, a gear train, and the like, for example). The thermal activation platen roller 41 is rotated in a clockwise direction, and the heat-sensitive adhesive label L is transported to the right hand side by the insertion roller 30 and the discharge roller 31. It should be noted that the thermal activation platen roller 41 may also be configured by using hard rubber or the like.

The cutter unit C cuts the heat-sensitive adhesive label L, which has undergone thermal activation processing by the thermal activation unit A, to a suitable length. The cutter unit C includes a movable blade 20, a stationary blade 21, and the like that are operated by a drive source (not shown) such as an electric motor. It should be noted that a cutter drive unit 20A (not shown) of the movable blade 20 operates at a predetermined timing by control of the control device 1500, which is described later.

Further, sensors S1, S2, and S3 that detect the presence or absence of the heat-sensitive adhesive label L are disposed between the heat-sensitive adhesive sheet roll R and the printing unit I, between the insertion roller 30 and the thermal activation platen roller 41, and after the cutter unit C, respectively.

Further, a temperature sensor K that measures temperature is disposed in the thermal-activation thermal head 40.

As shown in FIG. 2, the control device 1500 of the thermal printer apparatus P1 includes a one chip microcomputer 1000 that supervises a control unit, a ROM 1010 that stores a control program and the like that are executed by the microcomputer 1000, a RAM 1020 that stores a variety of print formats and the like, an operation portion 1030 that performs input of print data, print format data, and the like, makes settings, and makes calls, a display unit 1040 that is configured by a liquid crystal display panel or the like that displays print data and the like, and an interface 1050 that performs input and output of data between the control portion and driven devices.

The heater element Hi of the thermal print head 10 of the printing unit I, the heater element H2 of the thermal-activation thermal head 40 of the thermal activation unit A, the cutter drive unit 20A of the cutter unit C, the first stepping motor M1, the second stepping motor M2, and a third stepping motor M3, and the heat-sensitive adhesive label detection sensors S1, S2, and S3 are each connected to the interface 1050.

Figure 8:
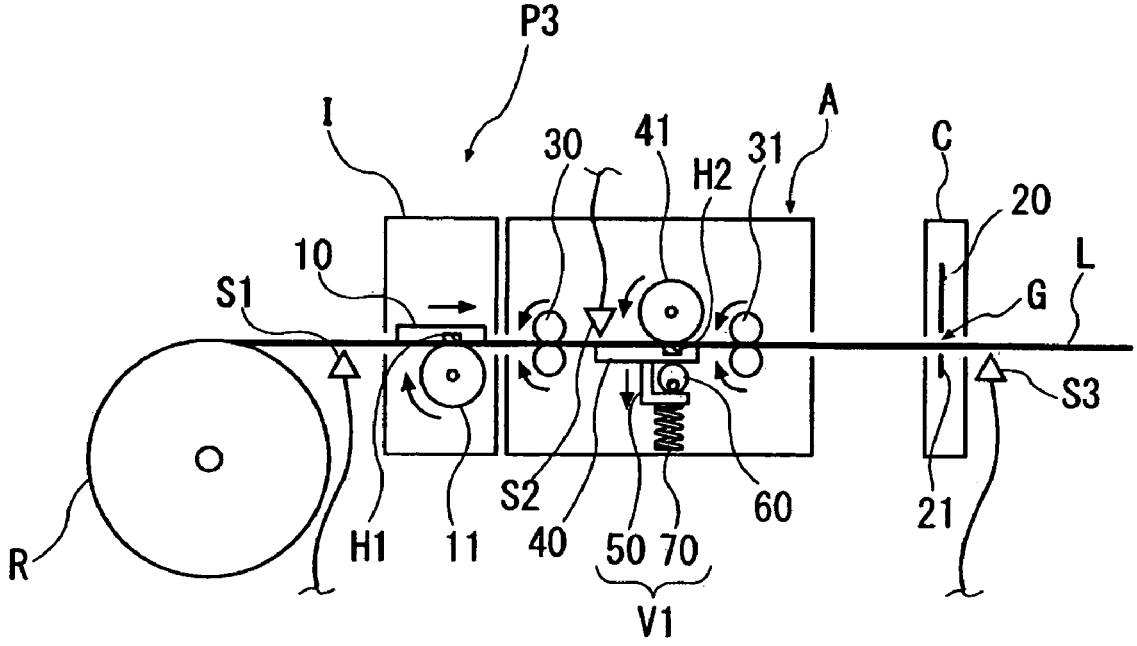
FIG. 8 is a schematic diagram that shows a configuration of a thermal printer apparatus according to a third embodiment of the present invention.

It should be noted that the third stepping motor M3 or a solenoid 80 shown in FIG. 2 are drive sources for thermal head separating mechanisms V1 and V2 shown in FIGS. 8 to 10.

Operations of the thermal printer apparatus PI according to the first embodiment having a configuration like that described above is outlined here. Predetermined heat-sensitive printing is first performed to the printable surface (front side in FIG. 1) in the printing unit I after the heat-sensitive adhesive label L is drawn out from the heat-sensitive adhesive sheet roll R, and the heat-sensitive adhesive label L is then transported to the thermal activation unit A, according to control of the control device 1500.

Next, thermal activation processing of the heat-sensitive adhesive layer of the heat-sensitive adhesive label L is performed in the thermal activation unit A, and adhesion develops. The heat-sensitive adhesive label L is then transported to the cutter unit C.

A portion of the heat-sensitive adhesive label L having a predetermined length is then transported. Transporting of the heat-sensitive adhesive label L is stopped when a cutting position G arrives at the blades 20 and 21 of the cutter unit C. The movable blade 20 is then driven, performing cutting.

At this point, a process for preventing thermal activation and color development which prevents activation of, and color development in, the heat-sensitive adhesive label L located on the thermal-activation thermal head 40 is implemented, although detailed control procedures for this processing are described later. That is, transporting of the heat-sensitive adhesive label L is stopped when the cutter unit C cuts the heat-sensitive adhesive label L. Residual heat remains for a predetermined period of time even after thermal activation processing in the thermal activation unit A ends, and electric power to the heater element H2 is cut off. There is therefore a danger that unnecessary activation and color development may occur in the heat-sensitive adhesive label L located on the thermal-activation thermal head 40. It is therefore necessary to prevent the unnecessary activation and color development.

The temperature of the thermal-activation thermal head 40 is measured by the temperature sensor K with the process for preventing thermal activation and color development heat in this embodiment. Transporting of the heat-sensitive adhesive label L is continued until the temperature becomes equal to or less than the predetermined temperature (70° C., for example) The cutting position G of the heat-sensitive adhesive label L is adjusted to reach the position of the blades 20 and 21 of the cutter unit C when the temperature becomes equal to or less than the predetermined temperature, and cutting processing is then performed. The thermal-activation thermal head 40 is thus cooled to a temperature equal to or less than the predetermined temperature when performing cutting of the heat-sensitive adhesive label L. Accordingly, unnecessary activation of, and color development in, the heat-sensitive adhesive label L can be prevented.

It should be noted that the remainder portion of the heat-sensitive adhesive label L is transported in a direction (left hand side in FIG. 1) that is opposite to the normal transporting direction by control of the control device 1500 after the cutting processing of the heat-sensitive adhesive label L is complete. The leading edge portion is stopped in front of the thermal print head 10 of the printing unit I. Even if an area where thermal activation processing is not implemented remains in the leading edge portion of the remainder portion before the cutting position G of the heat-sensitive adhesive label L, the thermal-activation thermal head 40 reliably performs thermal activation processing in the next process. At minimum, development of an inactive portion (region where adhesion does not develop) in the heat-sensitive adhesive layer of the leading edge portion of a heat-sensitive adhesive label L1 after cutting is prevented, and peeling of the heat-sensitive adhesive label L1 during application to an object is less likely to occur.

Figure 6:
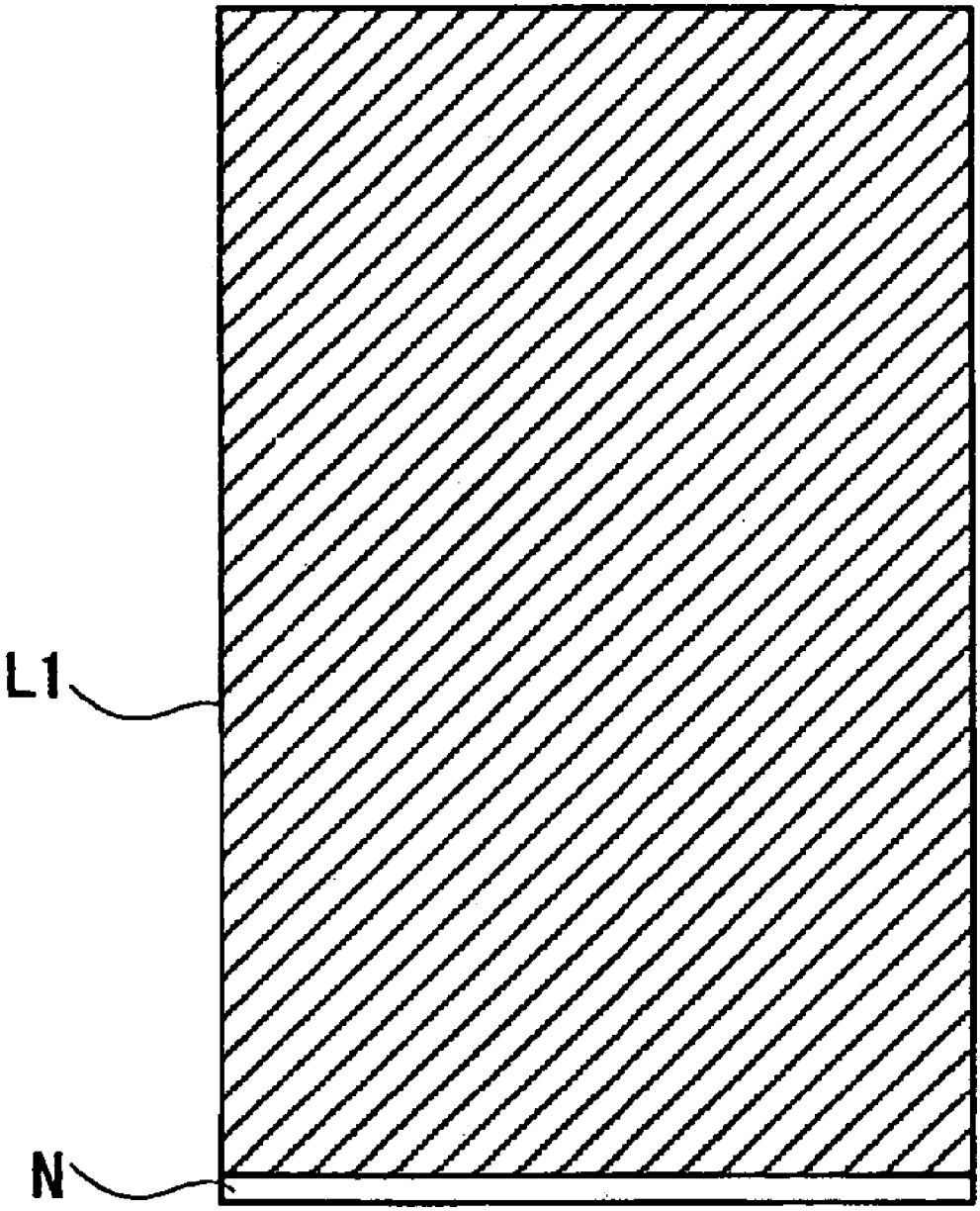
FIG. 6 is an explanatory diagram that shows a heat-sensitive adhesive label L1 that is cut by a cutter unit C.

Furthermore, the inactive area that is separated by a predetermined distance (several millimeters, for example), and in a direction that is opposite to the transporting direction, from the position where activation by the thermal-activation thermal head 40 is complete can be formed as the cutting position G of the heat-sensitive adhesive label L by controlling the timing at which electric power is connected to the thermal-activation thermal head 40. The heat-sensitive adhesive layer in the cutting position G of the heat-sensitive adhesive label L can thus be taken as inactive. Conditions where the heat-sensitive adhesive adheres to the blades 20 and 21 of the cutter unit C, lowering the cutting quality, can thus be avoided. In fact, although an inactive area N like that shown in FIG. 6, for example, remains in one edge portion of the heat-sensitive adhesion label L1 after cutting, it has a small width. Accordingly, it is thought that influence imparted to the adhesion performance is minute.

Figure 3:
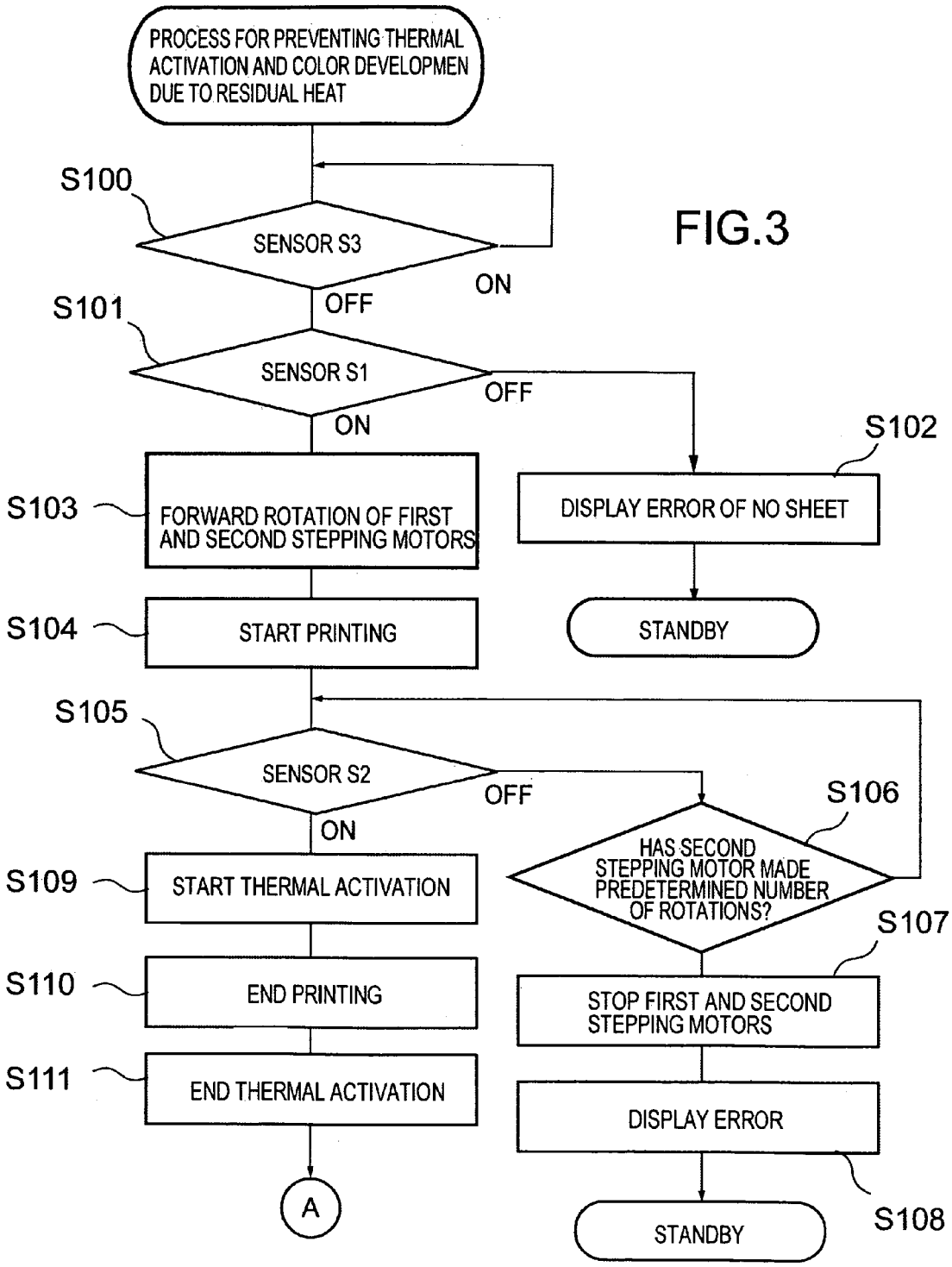
FIG. 3 is a flowchart that shows a process order of a process of preventing activation and color development due to residual heat in a thermal printer apparatus according to a first embodiment of the present invention.
Figure 4:
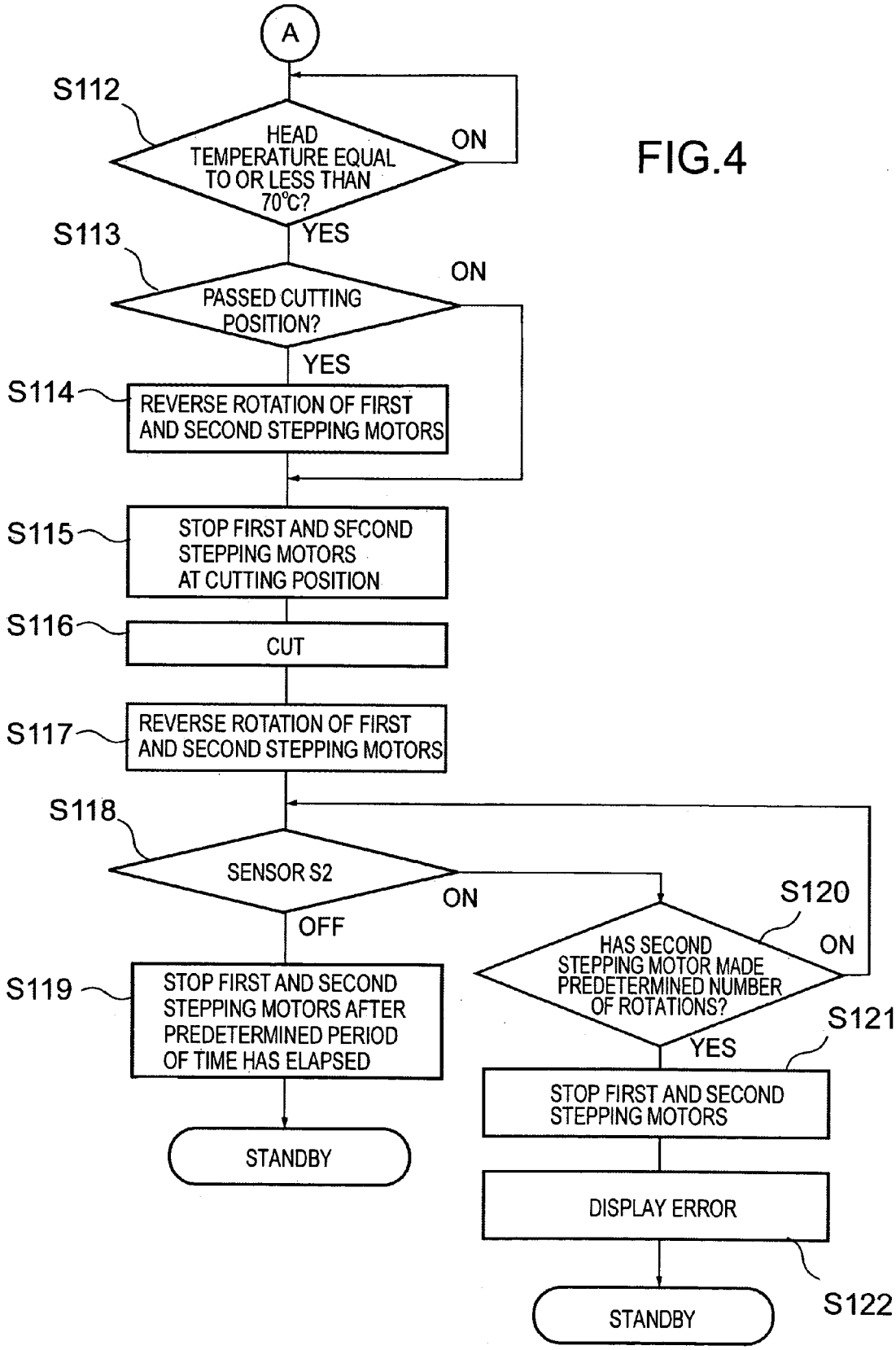
FIG. 4 is a flowchart that shows a continuation of the process order of FIG. 3.

Referring to the flowcharts of FIG. 3 and FIG. 4, and the explanatory diagram of FIG. 5, a specific process order for the process for preventing thermal activation and color development due to residual heat is explained here.

When the process for preventing thermal activation and color development due to residual heat is started, first a determination is made in step S100 as to whether the sensor S3 is in an on state or in an off state. Waiting continues when the sensor S3 is in an on state. For cases where it is determined that the sensor S3 is in an off state, processing proceeds to step S101.

In step S101, a determination is made as to whether the sensor S1 is in an on state or in an off state. Processing advances to step S102 for cases where it is determined that the sensor S1 is in an off state, a no-sheet error is displayed in the display unit 1040, and a standby state then occurs. The user can thus exchange the roll R or remove jammed paper.

On the other hand, for cases where it is determined that the sensor S1 is in an on state, forward rotation is started for the first stepping motor M1 of the printing unit I and the second stepping motor M2 of the thermal activation unit A. Transporting of the heat-sensitive adhesive label L begins. Processing then proceeds to step S104, and printing processing according to the thermal print head 40 of the printing unit I begins.

Processing advances next to step S105, and the on or off state of the sensor S2 is determined. Processing proceeds to step S106 for cases where the sensor S2 is in an off state. A determination is made as to whether or not the second stepping motor M2 of the thermal activation unit A has rotated by a predetermined number of rotations. Processing returns to step S105 if the determination result is negative (No), and transporting continues. For cases where the determination result is positive (Yes), the first stepping motor M1 and the second stepping motor M2 are stopped in step S107, and display of an error such as "paper jam" or the like is performed in step S108.

On the other hand, for cases where the sensor S2 is determined to be in an on state in step S105, processing advances to step S109. Electric power is supplied to the thermal-activation thermal head 40 of the thermal activation unit A, and thermal activation processing of the heat-sensitive adhesive label L begins.

Processing then advances to step S110, and printing processing ends after a predetermined period of time elapses. Processing next advances to step S111, and thermal activation processing ends after a predetermined period of time elapses (that is, electric power to the thermal-activation thermal head 40 is cut off).

Figure 5A:
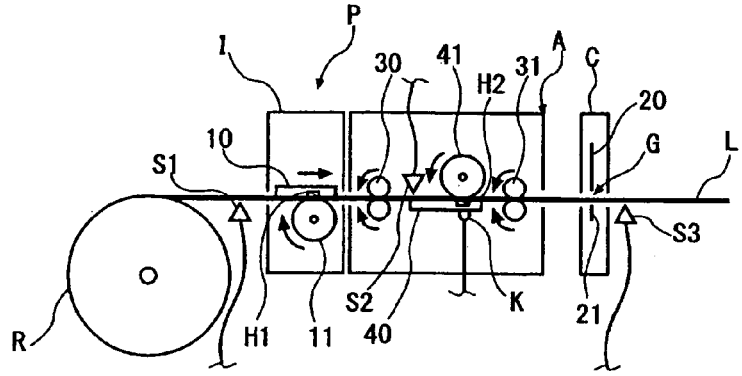
FIGS. 5A to 5D are explanatory diagrams that show operation of the thermal printer apparatus according to the first embodiment of the present invention.

Referring to FIG. 5A, the leading edge portion of the heat-sensitive adhesive label L is transported, passing through the cutter unit C.

Processing next jumps to a point A of the flowchart of FIG. 4. In step S112, a determination is made as to whether or not the residual heat temperature of the thermal-activation thermal head 40 is equal to or less than 70° C. It should be noted that the residual heat temperature is not limited to 70° C. The residual heat temperature may of course be suitably changed to conform to the temperature characteristics of the heat-sensitive adhesive layer and the heat-sensitive color-developing layer of the heat-sensitive adhesive label L.

For cases where the determination result is negative (No), processing waits for the thermal-activation thermal head 40 to cool. If the determination result is positive (Yes), processing then advances to step S113.

In step S113, a determination is made as to whether or not the cutting position G of the heat-sensitive adhesive label L has passed through the cutting unit C. This determination is made by computing the number of rotations of the first stepping motor M1 and the number of rotations of the second stepping motor M2, for example. For cases where the determination result is negative (No), processing advances to step S115. If the determination result is positive (Yes), processing proceeds to step S114, and the first stepping motor M1 and the second stepping motor M2 are rotated reversely by a predetermined number of rotations. The first stepping motor M1 and the second stepping motor M2 are then stopped at a predetermined timing in step S115. Positioning of cutting position G and the blades 20 and 21 of the cutter unit C is thus performed.

Next, in step S116, the cutter drive unit 20A of the cutter unit C is driven, executing cutting processing by the movable blade 20.

Figure 5B:
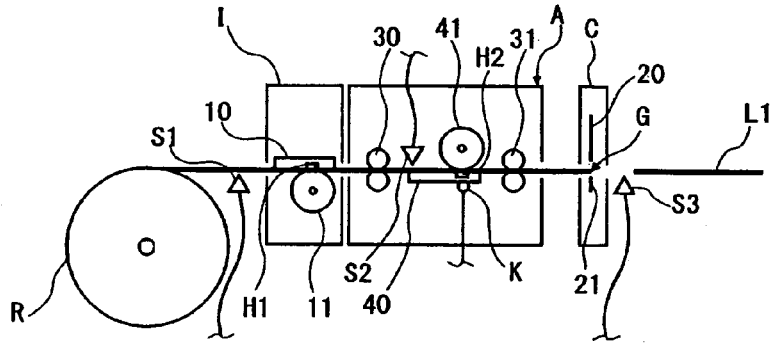

The heat-sensitive adhesive label L1 to be applied is thus cut as shown in FIG. 5B. Transporting of the subsequent heat-sensitive adhesive label L is stopped at this point. Although a portion of the heat-sensitive adhesive label L is stopped while contacting the thermal-activation thermal head 40, conditions where unnecessary activation or color development occurs can be avoided because the thermal-activation thermal head 40 has cooled to a temperature equal to or less than 70° C.

Figure 5C:
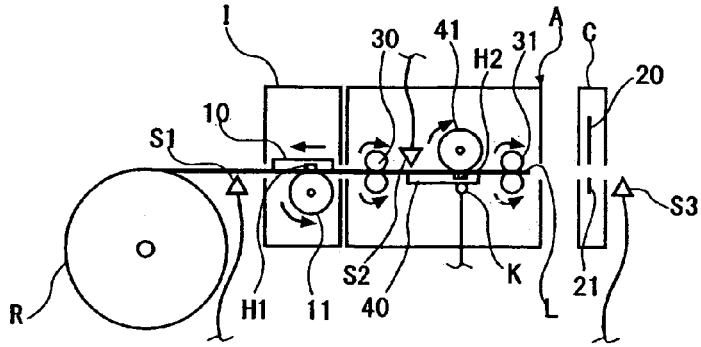
Figure 5D:
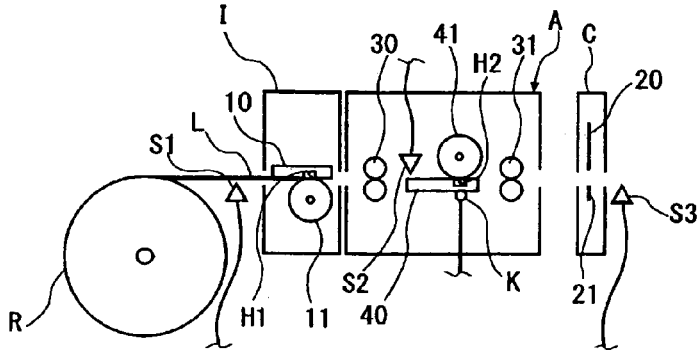

Processing then advances to step S117, and the first stepping motor M1 and the second stepping motor M2 are operated in reverse. Transporting of the subsequent heat-sensitive adhesive label L in a direction (to the left hand side in FIGS. 5A to 5D) opposite to the normal transporting direction then begins as shown in FIG. 5C. Processing next advances to step S118, and a determination is made as to whether the sensor S2 is on or off. For cases where it is determined that the sensor S2 is off, processing advances to step S119, and the first stepping motor M1 and the second stepping motor M2 are stopped after a predetermined period of time has elapsed, resulting in a standby state. The leading edge portion of the subsequent heat-sensitive adhesive label L can thus be stopped in a state of being located in front of the thermal print head 10, as shown in FIG. 5D. Printing processing and thermal activation processing can therefore be performed reliably from the beginning of the heat-sensitive adhesive label L when issuing the next label.

On the other hand, for cases where the determination result is negative (No) in step S118, processing advances to step S120, and a determination is made as to whether the first stepping motor M1 and the second stepping motor M2 have made a predetermined number of rotations. For cases where the determination result is negative (No), rotation continues. For cases where the determination result is positive (Yes), the first stepping motor M1 and the second stepping motor M2 are stopped in step S121. Display of an error such as "abnormality occurred" is conducted in step S122, and a standby state results.

According to this embodiment, printing processing to the printable surface of the heat-sensitive adhesive label L can thus be performed by the thermal print head 10, and activation processing of the heat-sensitive adhesive layer can be performed next by the thermal-activation thermal head 40. The heat-sensitive adhesive label is then cut into a predetermined length by the cutter unit C. Conditions where the heat-sensitive adhesive label adheres to the printing platen roller, causing paper jam, due to activation processing being performed ahead of printing processing as in a conventional thermal printer can therefore be avoided.

Further, after the leading edge side of the heat-sensitive adhesive label L is cut at the predetermined cutting position G by the cutter unit C, the leading edge of the remainder portion (the subsequent heat-sensitive adhesive label L) before the cutting position of the heat-sensitive adhesive label L returns to the thermal print head 10 position or to the thermal-activation thermal head 40 position. Therefore, even if an area where thermal activation processing is not performed remains in the leading edge portion of the remainder portion in front of the cutting position G of the heat-sensitive adhesive label L, thermal activation processing is performed reliably by the thermal-activation thermal head 40 in the next process. Accordingly, an inactive portion (region where adhesion does not develop) at least does not occur in the heat-sensitive adhesive layer of the leading edge portion of the heat-sensitive adhesive label L after cutting. Peeling during application to an object does not tend to occur.

Furthermore, the temperature sensor K that measures the temperature of the thermal-activation thermal head 40 is provided. For cases where the temperature measured by the temperature sensor K is greater than or equal to a predetermined value (70° C., for example), transporting of the heat-sensitive adhesive label L continues. For cases where the measured temperature is equal to or less than the predetermined value (70° C., for example), the first stepping motor M1 and the second stepping motor M2 are driven so that the cutting position G of the heat-sensitive adhesive label L arrives at the cutter unit C and stops. The cutter unit C is then driven. The thermal-activation thermal head 40 is thus at a temperature equal to or less than the predetermined temperature when the cutter unit C cuts the heat-sensitive adhesive label L. Conditions where the heat-sensitive adhesive layer is activated, or where the heat-sensitive color-developing layer of the printable surface develops color due to residual heat can therefore be reliably avoided.

Referring to FIGS. 7A to 7D, a thermal printer apparatus P2 according to a second embodiment of the present invention is explained next.

The structure of the thermal printer apparatus P2 is substantially similar to that of the thermal printer apparatus P1 according to the first embodiment, described above. The thermal printer apparatuses differ as follows. The temperature sensor K does not exist in the thermal printer apparatus P2, and the distance from the heater element H2 of the thermal-activation thermal head 40 to the blades 20 and 21 of the cutter unit C has been increased in the thermal printer apparatus P2.

Figure 7A:
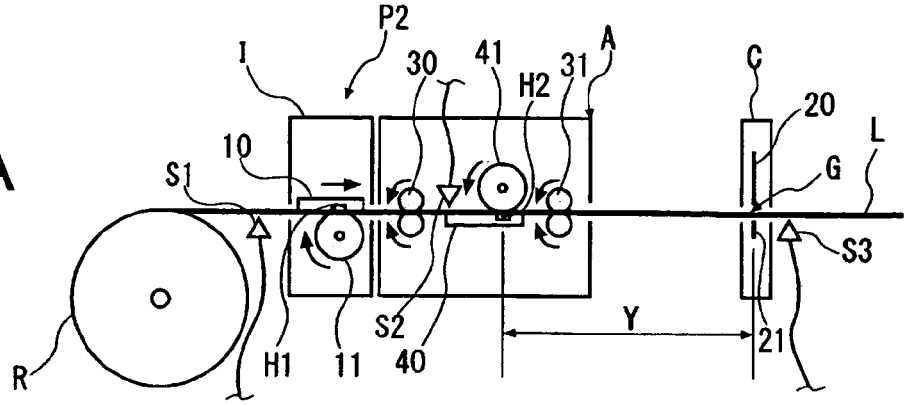
FIGS. 7A to 7D are explanatory diagrams that show operation of a thermal printer apparatus according to a second embodiment of the present invention.

Referring to FIG. 7A, a distance Y from the heater element H2 of the thermal-activation thermal head 40 to the blades 20 and 21 of the cutter unit C is set so that the thermal-activation thermal head 40 reaches a temperature equal to or less than a predetermined temperature (70° C., for example) when the cutting position G of the heat-sensitive adhesive label L reaches the position of the blades 20 and 21 of the cutter unit C. The thermal-activation thermal head 40 is thus already cooled to a temperature equal to or less than the predetermined temperature (70° C., for example) when the cutter unit C performs cutting processing on the heat-sensitive adhesive label L. Accordingly, conditions where the heat-sensitive adhesive layer is activated, or where the heat-sensitive color-developing layer of the printable surface develops color due to residual heat can be reliably avoided.

It should be noted that the distance Y differs according to the transport speed of the heat-sensitive adhesive label L (rotation speed of the first and the second stepping motors, and the like), and may therefore be set considering these parameters.

Figure 7B:
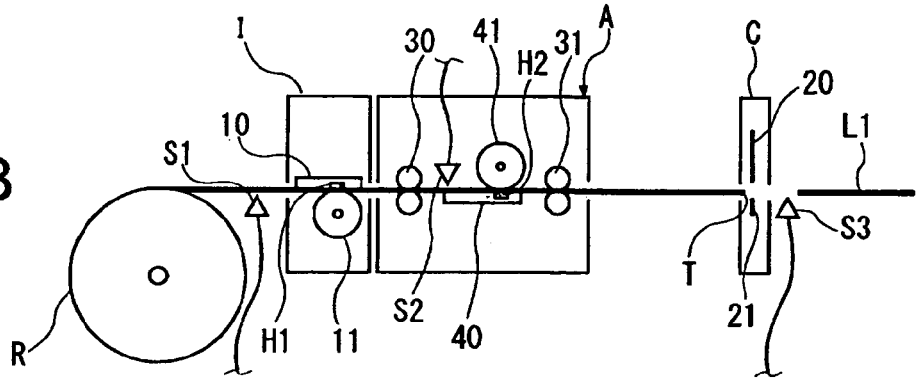
Figure 7C:
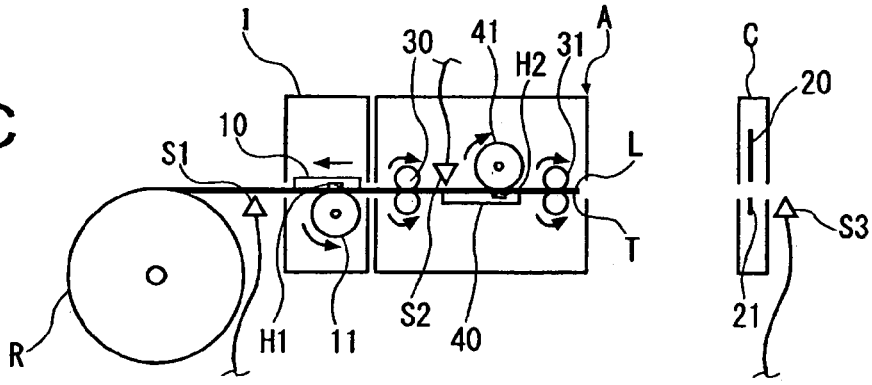
Figure 7D:
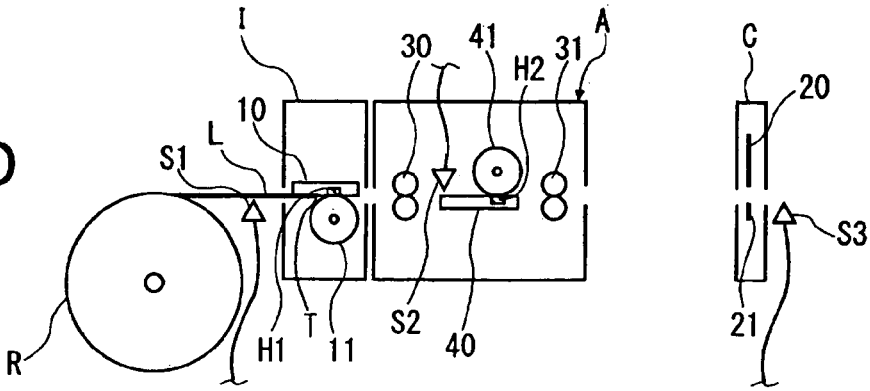

Further, control is performed so that, after the cutter unit C performs cutting processing on the heat-sensitive adhesive label L, the first stepping motor M1 and the second stepping motor M2 are rotated in reverse from the state of FIG. 7B, similar to the first embodiment. The heat-sensitive adhesive label L is transported in a direction (a left hand direction in FIG. 7C) that is opposite to the normal transporting direction. The heat-sensitive adhesive label is stopped in front of the thermal print head 10, as shown in FIG. 7D. Printing processing and thermal activation processing can thus be performed reliably from the beginning of the heat-sensitive adhesive label L when issuing the next label.

According to the second embodiment, thermal activation and unnecessary color development due to residual heat can be avoided without performing control for adjusting the transporting time and the stopping position of the heat-sensitive adhesive label L based on results of measuring the temperature of the thermal-activation thermal head 40 by using the temperature sensor K, as in the first embodiment. This can be achieved by a simple structure in which the distance Y from the heater element H2 of the thermal-activation thermal head 40 to the blades 20 and 21 of the cutter unit C is suitably set.

Referring to FIGS. 8, 9A and 9B, and 10A and 10B, a thermal printer apparatus P3 according to a third embodiment of the present invention is explained next.

The thermal printer apparatus P3 according to the third embodiment is configured by omitting the temperature sensor K from the thermal printer apparatus P1 of the first embodiment, and by providing a thermal head separator mechanism V1 that withdraws the thermal-activation thermal head 40 from the thermal activation platen roller 41. The first stepping motor M1 and the second stepping motor M2 are stopped when the cutting position G of the heat-sensitive adhesive label L reaches the position of the blades 20 and 21 of the cutter unit C, and the thermal head separator mechanism V1 is operated. The heat-sensitive adhesive layer of the heat-sensitive adhesive label L located at the thermal-activation thermal head 40 is thus separated from the surface of the thermal-activation thermal head 40 when the cutter unit C performs cutting processing on the heat-sensitive adhesive label L. Accordingly, conditions where the heat-sensitive adhesive layer is activated, or where the heat-sensitive color-developing layer of the printable surface develops color due to residual heat can be reliably avoided.

Figure 9A:
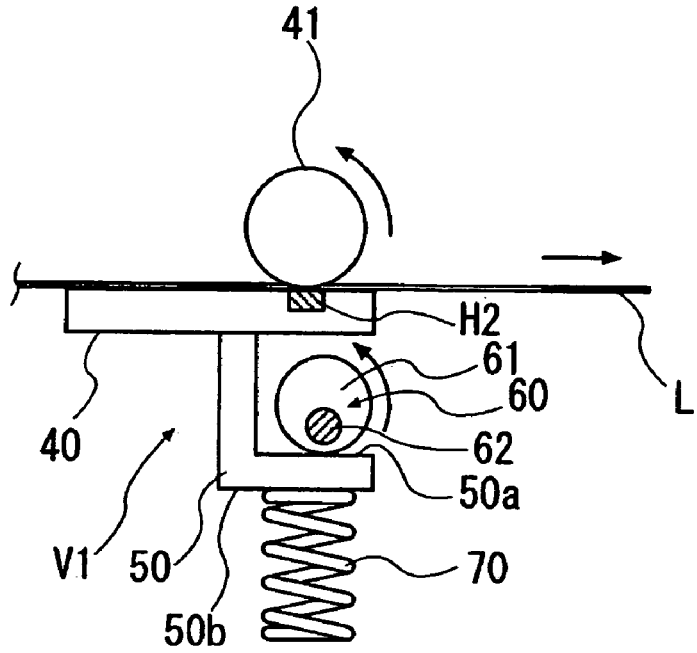
FIGS. 9A and 9B are explanatory diagrams that show a configuration and operation of a thermal head separator mechanism V1 of the thermal printer apparatus according to the third embodiment of the present invention.
Figure 9B:
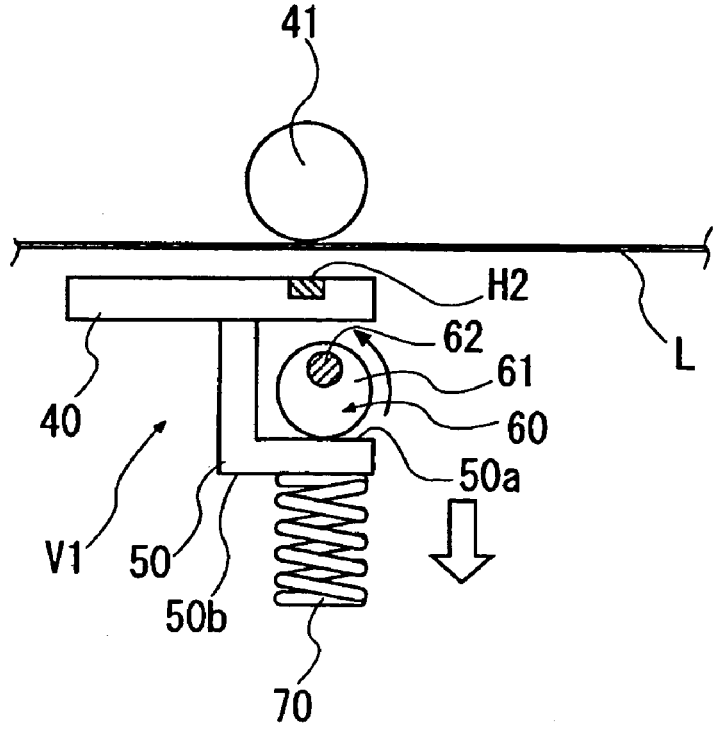
Figure 10A:
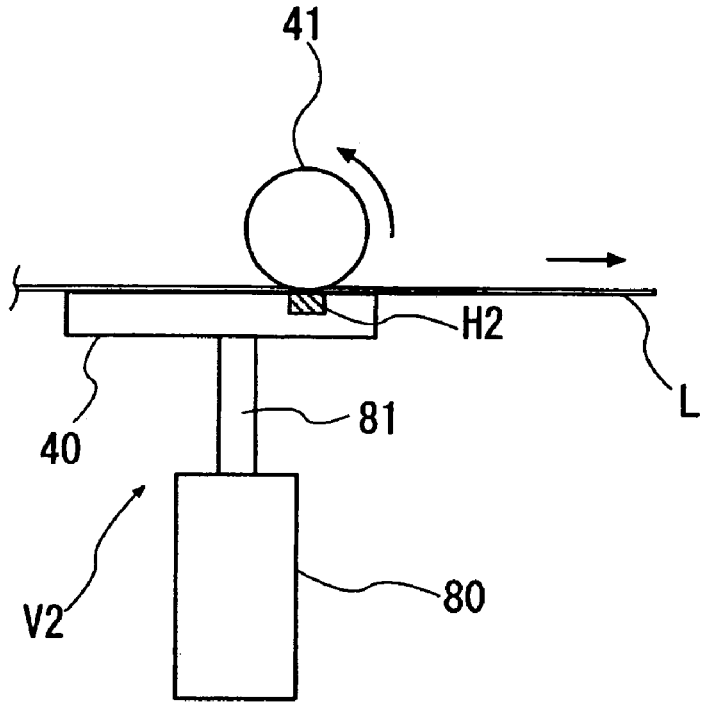
FIGS. 10A and 10B are explanatory diagrams that show a configuration and operation of a thermal head separator mechanism V2 of the thermal printer apparatus according to the third embodiment of the present invention.
Figure 10B:
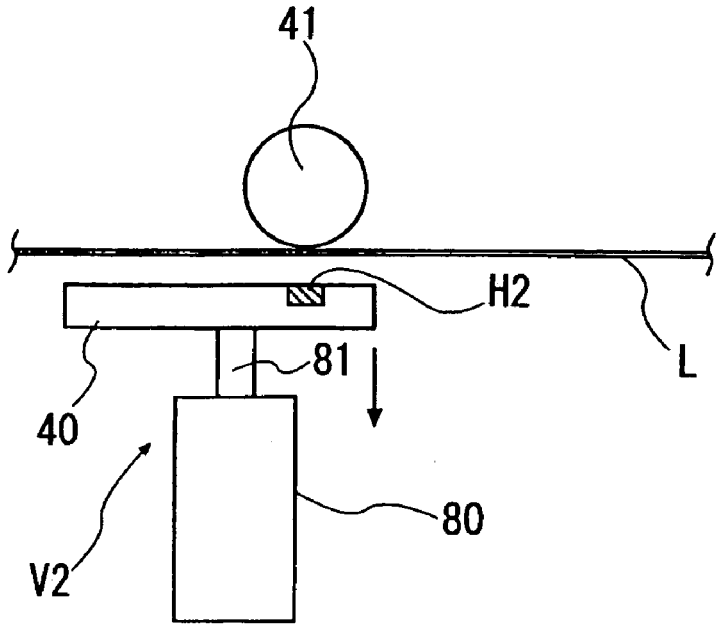

Referring to FIGS. 9A and 9B, the thermal head separator mechanism V1 is provided on a lower surface side of the thermal-activation thermal head 40. The thermal head separator mechanism V1 includes an L-shape actuated striker member 50 that can move upward and downward together with the thermal-activation thermal head 40, a cam mechanism 60 that contacts a horizontal portion 50*a* of the actuated striker member 50 and that converts rotational motion into upward and downward motion, and a spring 70 that normally presses the thermal-activation thermal head 40 against the thermal activation platen roller 41, and that is disposed below the actuated striker member 50.

The cam mechanism 60 is configured from an eccentric cam 60, a rotation shaft 62, and a third stepping motor M3 that is used as a drive source and is not shown.

Transporting processing, printing processing, and thermal activation processing of the heat-sensitive adhesive label L are performed by control similar to that used with the thermal printer apparatus P1 according to the first embodiment described above. Operation of the third stepping motor M3 is started when it is determined that the cutting position G of the heat-sensitive adhesive label L has reached the blades 20 and 21 of the cutter unit C. The eccentric cam 60 is rotated by 180 degrees in a counter clockwise direction from its position in FIG. 9A, resulting in the state of FIG. 9B.

The actuated striker member 50 and the thermal-activation thermal head 40 are thus pushed downward by the action of the eccentric cam 60, and the heat-sensitive adhesive layer of the heat-sensitive adhesive label L located at the thermal-activation thermal head 40 separates from the surface of the thermal-activation thermal head 40. Conditions where the heat-sensitive adhesive layer is activated, or where the heat-sensitive color-developing layer of the printable surface develops color due to residual heat of the thermal-activation thermal head 40 when transporting of the heat-sensitive adhesive label L is stopped in order for the cutter unit C to perform cutting processing can therefore be reliably avoided.

In particular, it is not necessary to wait for the temperature of the thermal-activation thermal head 40 to become equal to or less than a predetermined temperature, as with the first embodiment and the second embodiment. Very fast label issuing can therefore be performed.

Further, referring to FIG. 10, a thermal head separator mechanism V2 that uses a solenoid 80 as a drive source can also be employed as a substitute for the cam mechanism 60.

The thermal head separator mechanism V2 is structured by joining a plunger 81 of the solenoid 80 to a lower surface of the thermal-activation thermal head 40. The solenoid 80 is driven when it is determined that the cutting position G of the heat-sensitive adhesive label L has reached the position of the blades 20 and 21 of the cutter unit C. The plunger 81 is pulled down from its position in FIG. 10A, resulting in the state of FIG. 10B.

The actuated striker member 50 and the thermal-activation thermal head 40 move downward, and the heat-sensitive adhesive layer of the heat-sensitive adhesive label L that is located at the thermal-activation thermal head 40 separates from the surface of the thermal-activation thermal head 40. Conditions where the heat-sensitive adhesive layer is activated, or where the heat-sensitive color-developing layer of the printable surface develops color due to residual heat of the thermal-activation thermal head 40 when transporting of the heat-sensitive adhesive label L is stopped in order for the cutter unit C to perform cutting processing can therefore be reliably avoided.

It should be noted that it is also possible to use a variety of actuators, such as a pneumatic cylinder apparatus or a hydraulic cylinder apparatus, as a substitute for the solenoid 80.

The present invention made by the inventors has been explained in detail above based on the embodiments. The present invention is not, however, limited to the embodiments described above. A variety of changes are also possible in a range that does not deviate from the gist of the invention.

For example, although the first stepping motor M1 of the printing unit I and the second stepping motor M2 of the thermal activation unit A transport the heat-sensitive adhesive label L in the embodiments described above, transporting processing may also be performed by employing one stepping motor that uses a gear train having a predetermined structure as a substitute.

Further, cooling means such as a cooling fan may also be provided so that the residual heat of the thermal-activation thermal head 40 can be removed in a short period of time.

As explained above, the printer apparatus according to the present invention includes the thermal print head that performs printing by contacting the heat-sensitive color-developing layer of the heat-sensitive adhesive sheet that includes the printable surface made from the heat-sensitive color-developing layer on one surface of the sheet-like base material, and the heat-sensitive adhesive layer on another surface of the sheet-like base material; the thermal-activation thermal head that activates the heat-sensitive adhesive layer by heating; the cutter device that cuts the heat-sensitive adhesive sheet; the transporting means for transporting the heat-sensitive adhesive sheet; and the controlling means for controlling the thermal print head, the thermal-activation thermal head, and the cutter device. The controlling means controls the transporting means to transport the heat-sensitive adhesive sheet so as to pass through the thermal print head, the thermal head used for activation, and the cutter device, in order. The controlling means also controls the transporting means to transport the leading edge of the remainder portion of the heat-sensitive adhesive sheet, after the cutter device cuts the heat-sensitive adhesive sheet, to return to the printing position of the thermal print head or to the heating position of the thermal-activation thermal head. There is an effect whereby a condition in which the heat-sensitive adhesive sheet adheres to the printing platen roller due to conventionally performing activation processing before printing processing, causing jam to develop, can be avoided.

Further, after the cutter device cuts the leading edge side of the heat-sensitive adhesive sheet at the predetermined cutting position, the leading edge of the remainder portion in front of the cutting position of the heat-sensitive adhesive sheet is returned to the thermal print head position or to the thermal-activation thermal head position. Therefore, even if an area in which thermal activation processing is not performed remains in the leading edge portion of the remainder portion in front of the cutting position of the heat-sensitive adhesive sheet, the thermal-activation thermal head reliably performs thermal activation processing in the next process. Accordingly, an in active portion (are a where adhesion does not develop) is prevented from occurring in at least the heat-sensitive adhesive layer of the leading edge portion of the heat-sensitive adhesive sheet after cutting, and there is an effect whereby peeling does not tend to occur during application to an object.

Furthermore, there is an effect whereby unnecessary activation and color development due to the thermal-activation thermal head can be prevented because the leading edge of the remainder portion in front of the cutting position of the heat-sensitive adhesive sheet is returned to the thermal print head position or to the thermal-activation thermal head position.

What is claimed is:

1. A printer apparatus, comprising:

a thermal print head that performs printing by contacting a heat-sensitive color-developing layer of a heat-sensitive adhesive sheet that comprises a printable surface made from the heat-sensitive color-developing layer on one surface of a sheet-like base material, and a heat-sensitive adhesive layer on another surface of the sheet-like base material;

a thermal-activation thermal head that activates the heat-sensitive adhesive layer by heating;

a cutter device that cuts the heat-sensitive adhesive sheet;

transporting means for transporting the heat-sensitive adhesive sheet; and controlling means for controlling the thermal print head, the thermal-activation thermal head, and the cutter device, wherein the controlling means controls the transporting means to transport the heat-sensitive adhesive sheet so as to pass through the thermal print head, the thermal head used for activation, and the cutter device, in order; and to transport a leading edge of a remainder portion of the heat-sensitive adhesive sheet, after the cutter device cuts the heat-sensitive adhesive sheet, to return to a printing position of the thermal print head or to a heating position of the thermal-activation thermal head.

2. A printer apparatus according to claim 1, further comprising a temperature sensor that measures a temperature of the thermal-activation thermal head, wherein the controlling means:

drives the transporting means to continue to transport the heat-sensitive adhesive sheet when the temperature of the thermal-activation thermal head measured by the temperature sensor is equal to or greater than a predetermined value;

drives the transporting means such that the cutting position of the heat-sensitive adhesive sheet stops at a cutting portion of the cutter device when the measured temperature of the thermal-activation thermal head is equal to or less than the predetermined value; and drives the cutter device to perform cutting.

3. A printer apparatus according to claim 1, wherein a distance from the thermal-activation thermal head to the cutter device, and a transport speed of the transporting means are set such that the thermal-activation thermal head is at a temperature equal to or less than a predetermined temperature when the cutting position of the heat-sensitive adhesive sheet reaches the cutter device.

4. A printer apparatus according to claim 1, further comprising a thermal head separating means for withdrawing a surface of the thermal-activation thermal head from the heat-sensitive adhesive sheet, wherein the controlling means stops the transporting means, and operates the thermal head separating means, when the cutting position of the thermal sensitive adhesive sheet reaches the cutter device.

5. A printer apparatus according to claim 4, wherein the thermal head separating means comprises:

an actuated striker member that is provided on a lower surface side of the thermal-activation thermal head and capable of upward and downward movement operation together with the thermal-activation thermal head; and a cam mechanism that contacts a portion of the actuated striker member and converts rotational motion into upward and downward motion.

6. A printer apparatus according to claim 4, wherein the thermal head separating means comprises:

an actuated striker member that is provided on a lower surface side of the thermal-activation thermal head and capable of upward and downward movement operation together with the thermal-activation thermal head; and an actuator that contacts a portion of the actuated striker member and causes the actuated striker member to move upward and downward.

7. A printer apparatus according to claim 6, wherein the actuator comprises one of a solenoid, a pneumatic cylinder apparatus, and a hydraulic cylinder apparatus.

8. A printer apparatus according to claim 1, wherein the cutting position of the heat-sensitive adhesive sheet comprises an inactivation position that is separated by a predetermined distance, in a direction that is opposite to a transporting direction, from a position at which activation by the thermal-activation thermal head is completed.

* * * * *